US006396037B1

(12) United States Patent
Rossouw et al.

(10) Patent No.: US 6,396,037 B1
(45) Date of Patent: May 28, 2002

(54) DIELECTRIC HEATING DEVICE

(75) Inventors: Mathys Johannes Rossouw, Cullinan; Eugene Avenant, Hartebeespoort, both of (ZA)

(73) Assignee: Technology Finance Corporation (Proprietary) Limited, Sandton (ZA)

( * ) Notice: Subject to any disclaimer, the term of this patent is extended or adjusted under 35 U.S.C. 154(b) by 0 days.

(21) Appl. No.: 09/706,273

(22) Filed: Nov. 3, 2000

(30) Foreign Application Priority Data

Nov. 3, 1999 (SA) ..... 99/6911

(51) Int. Cl.[7] ..... H05B 6/72; H01P 1/17

(52) U.S. Cl. ..... 219/746; 219/748; 219/750; 219/756; 333/21 A

(58) Field of Search ..... 219/746, 747, 219/748, 750, 695, 696, 756; 333/21 A

(56) References Cited

U.S. PATENT DOCUMENTS

| | | | | |
|---|---|---|---|---|
| 4,301,347 A | | 11/1981 | Quine | 219/10.55 |
| 4,324,968 A | | 4/1982 | Smith | 219/10.55 |
| 4,336,434 A | | 6/1982 | Miller | 219/10.55 |
| 5,948,310 A | * | 9/1999 | Shon et al. | 219/746 |
| 6,034,362 A | * | 3/2000 | Alton | 219/746 |
| 6,097,018 A | | 8/2000 | Kim et al. | 219/746 |

FOREIGN PATENT DOCUMENTS

| | | |
|---|---|---|
| GB | 2 318 039 | * 6/1998 |
| JP | 63-317068 | * 12/1988 |
| WO | WO 97/44988 | 11/1997 |

* cited by examiner

*Primary Examiner*—Philip H. Leung
(74) *Attorney, Agent, or Firm*—Fulbright & Jaworski L.L.P.

(57) ABSTRACT

The invention provides a dielectric heating device. The device includes a plurality of electrically conductive side walls which are electrically interconnected in use and arranged in series to define a heating cavity. At least one pair of adjacent side walls has its walls inclined to each other at a corner having an included angle selected from the group consisting of acute angles and obtuse angles. At least one electromagnetic power source capable of emitting electromagnetic radiation suitable for dielectric heating is arranged to feed waves of such radiation into the cavity with circular polarization of the waves, to cause the cavity to act as a multimode resonant heating cavity.

19 Claims, 3 Drawing Sheets

DIELECTRIC HEATING DEVICE

THIS INVENTION relates to a dielectric heating device. More particularly, it relates to a dielectric heating device suitable for microwave heating, and to an electromagnetic power source.

According to the invention, there is provided a dielectric heating device, the device including:

a plurality of electrically conductive side walls which are electrically interconnected in use and arranged in series to define a heating cavity, at least one pair of adjacent side walls being inclined to each other at a corner having an included angle selected from the group consisting of acute angles and obtuse angles; and at least one electromagnetic power source capable of emitting electromagnetic radiation suitable for dielectric heating, the power source being arranged to feed waves of such radiation into the cavity with circular polarization of the waves, to cause the cavity to act as a multimode resonant heating cavity.

The heating cavity may be a heating cavity as described in international patent application number PCT/NL97/00282 published under number WO 97/44988, the contents thereof being incorporated herein by reference.

The electromagnetic power source may be capable of emitting electromagnetic waves in the form of microwaves suitable for cooking foodstuffs; and the device may thus be in the form of a microwave oven. In a preferred embodiment of the invention the electromagnetic power source may include a microwave generator, eg a magnetron of a conventional microwave oven, or the like, and a waveguide having an inlet opening connected to the microwave generator, the waveguide also being connected to an inlet port into the heating cavity, and the waveguide being constructed to convert the linear polarization of the microwaves to a circular polarization thereof, and to guide the microwaves having the circular polarization through the inlet port into the cavity. In other words, the waveguide may thus be arranged to convert electromagnetic waves which have a linear polarization to a resultant electromagnetic wave feed whose waves have a circular polarization and which are fed via the inlet port into the cavity.

The waveguide may be hollow and circular-cylindrical in shape, having an end wall and a curved side wall, the waveguide containing, in its interior, at least one conversion formation for converting microwaves having a linear polarization to microwaves having a circular polarization, the inlet opening of the waveguide being through the curved side wall thereof and the waveguide having an open end for feeding microwaves into the inlet port of the cavity. The conversion formations may be in the form of two panels in the form of blades or plates which extend radially inwardly from opposed inner sides of the circular cylindrical waveguide. Accordingly, the waveguide may include a pair of the conversion formations in the form of diametrically opposed flattened elongated panels, each panel projecting radially inwardly from the inner wall of the cylinder of the waveguide and having a long dimension extending lengthwise along the cylinder, the panels being coplanar and the radially inner edges of the panels being opposed to, and diametrically spaced from, each other. The invention thus extends to an electromagnetic radiation feed arrangement for a dielectric heating device which includes a hollow circular cylindrical waveguide as herein described.

In other embodiments, the waveguide may be in the form of a hollow elongate rectangular waveguide including a microwave inlet which is typically located at a waveguide end wall or at a corner of the waveguide between its ends. An electromagnetic feed from the source inlet may have a linear polarization, the inlet opening of the waveguide being arranged so that the resultant polarization of the waves in the hollow rectangular waveguide is circular. For example, the waveguide may be a hollow box of elongate-rectangular shape, the inlet opening of the waveguide being through a corner of the waveguide between two side walls of the waveguide, at a position between the ends of the waveguide, one end of the waveguide being open for feeding microwaves into the inlet port of the cavity. Instead, the waveguide may be a hollow box of elongate-rectangular shape, the waveguide having an open end for feeding microwaves into the inlet port of the cavity, the opposite end of the waveguide having a wall with a rectangular opening therethrough, the peripheral edges of the rectangular opening being inclined at an angle to the peripheral edges of said wall at the opposite end of the waveguide, a box-like compartment having an open end registering with and communicating with said rectangular opening being mounted on said wall at the opposite end of the waveguide, and the inlet opening of the waveguide being through a wall of the box-like compartment parallel to the long dimension of the waveguide. The invention thus also extends to an electromagnetic radiation feed arrangement for a dielectric heating device which includes a hollow rectangular waveguide as herein described.

It is to be appreciated that the waveguides may be used to feed circularly polarized waves into a heating cavity of any shape or size, e.g. a cavity with a square outline, pentagonal outline, or the like. Preferably, however, the heating cavity is pentagonal in plan view outline when viewed from above in horizontal section.

The invention extends also to an electromagnetic power source capable of emitting electromagnetic radiation suitable for dielectric heating, the power source including an electromagnetic radiation generator which generates electromagnetic waves having linear polarization, and a waveguide having an inlet opening connected to the generator, the waveguide being constructed to convert the linear polarization of the electromagnetic waves to circular polarization thereof and to guide the waves away from the generator.

The electromagnetic radiation generator may be a microwave generator, the power source optionally having a construction as described above with reference to the dielectric heating device of the present invention.

The invention is now described, by way of example, with reference to the accompanying diagrammatic drawings.

Figure 1:
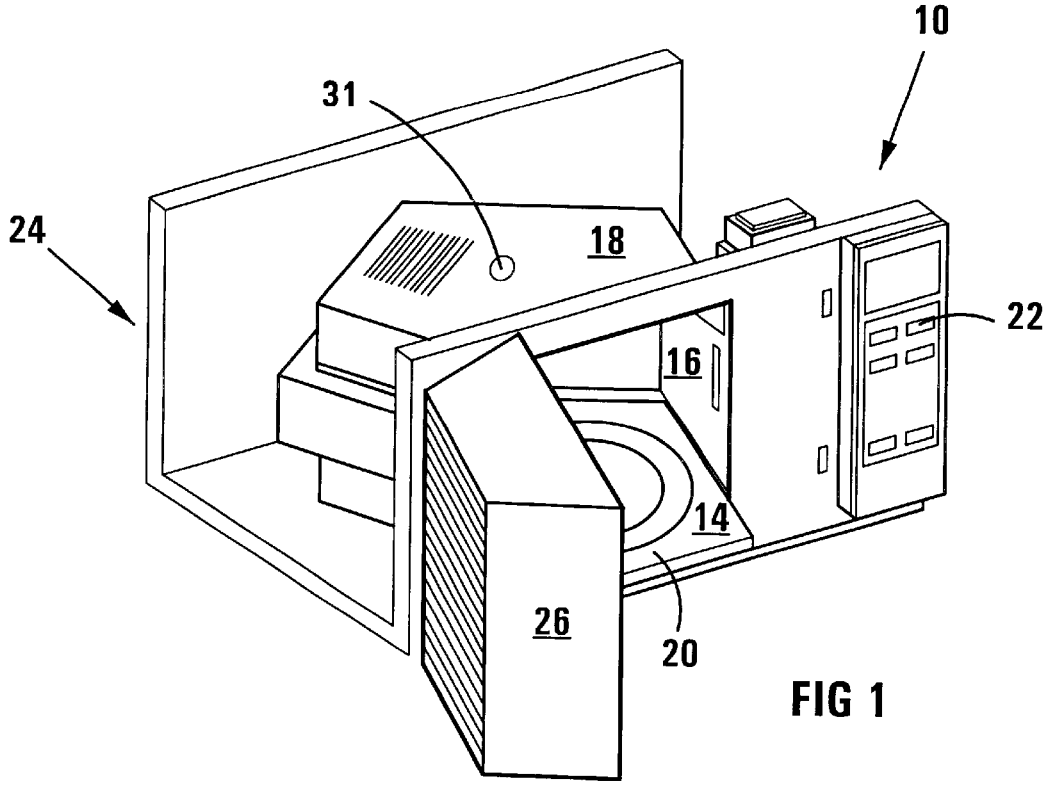
FIG. 1 shows a three-dimensional view of a dielectric heating device in accordance with the invention.

Referring first to FIG. 1 of the drawings, reference numeral 10 generally indicates a dielectric heating device in accordance with the invention. The device 10 includes an electromagnetic power source 12 (omitted from FIG. 1 but see FIGS. 2 to 3), and heating cavity 14 defined by electrically conductive vertical cavity side walls 1 6 and top and bottom cavity walls 18, 20 respectively. As described in more detail below, the electromagnetic power source is operable to feed electromagnetic waves which have a circular polarization into the heating cavity 14.

The heating device 10 is a microwave oven which may be used in both domestic and industrial applications for heating or cooking foodstuffs. Accordingly, conventional control circuitry with its associated control panel 22 is provided for controlling operation of the device 10. Likewise, the heating device 10 includes a housing (whose side walls and roof are omitted for ease of illustration) generally indicated by reference numeral 24 and an access door 26 which forms one of the vertical cavity walls 16 of the cavity 14. The vertical cavity walls 16 which define the heating cavity 14 are arranged so that, in horizontal section, the cavity 14 has a pentagonal plan view outline. It is however to be appreciated that the vertical cavity walls 16 may define an outline of any shape e.g. rectangular, hexagonal, octagonal, or the like.

Figure 2:
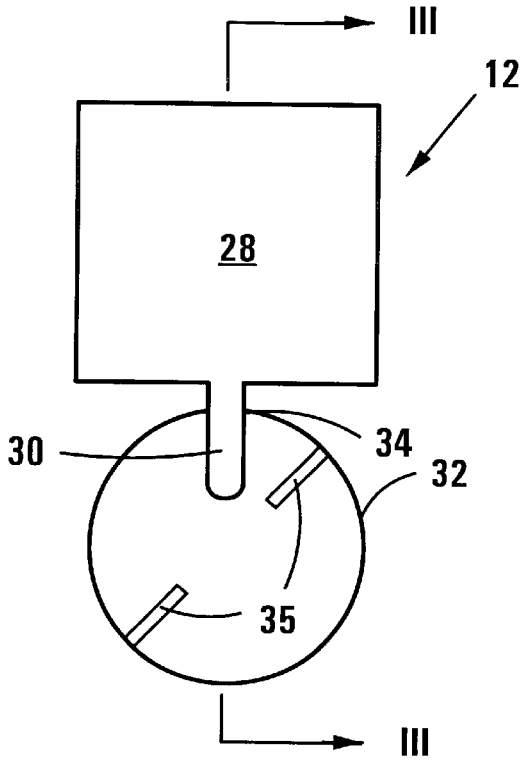
FIG. 2 shows an axial view of an electromagnetic power source of the device of FIG. 1, along line II—II in FIG. 3.
Figure 3:
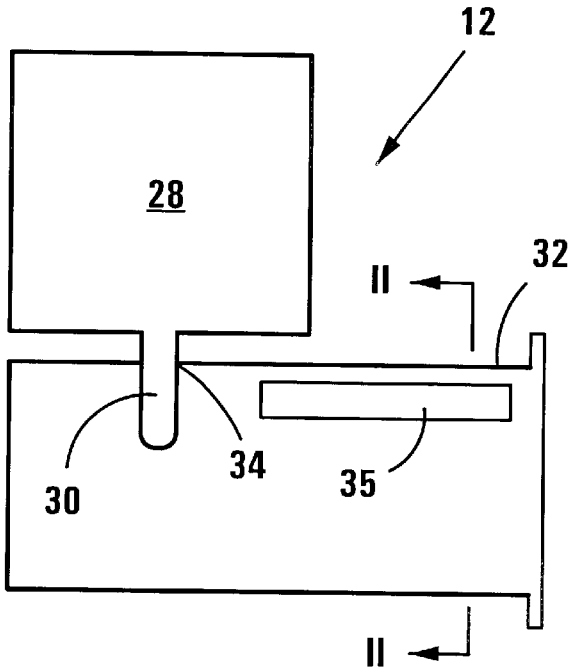
FIG. 3 shows a longitudinal sectional view of the electromagnetic power source of FIG. 2 along line III—III in FIG. 2.
Figure 4:
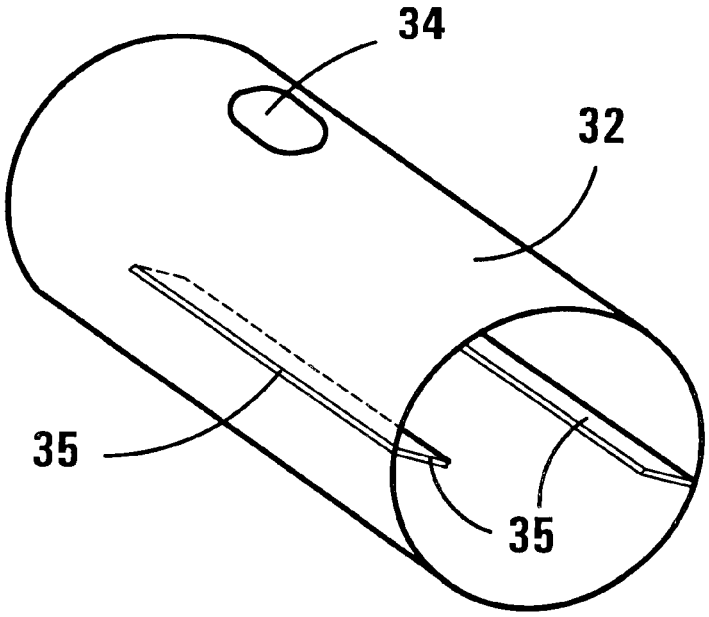
FIG. 4 shows a three dimensional view of a hollow circular-cylindrical waveguide, in accordance with the invention, of the electromagnetic power source of FIGS. 2 and 3.

Referring now in particular to FIGS. 2 to 4 of the drawings, the electromagnetic power source 12 is arranged to generate electromagnetic radiation in the form of microwaves by means of a conventional magnetron 28 via its antenna 30. The magnetron 28 is a conventional magnetron of the type used in conventional microwave ovens. The electromagnetic power source 12 is connected to a hollow circularcylindrical waveguide 32, in accordance with the invention, which couples the magnetron 28 to an inlet port 31 provided in the top wall 18 (see FIG. 1).

The cylindrical waveguide 32 has an inlet opening 34 which acts as an antenna inlet, inwardly through which the antenna 30 of the magnetron 28 projects, thereby to induce electromagnetic radiation in the form of microwaves within the interior of the cylindrical waveguide 32. The microwaves produced by the magnetron 28 are linearly polarized when fed into the cylindrical waveguide 32.

The cylindrical waveguide 32 includes a pair of conversion formations 35 which are diametrically opposed panels in the form of coplanar plates or blades which project radially inwardly and extend lengthwise along the waveguide 32. The conversion formations 35 are arranged to act to convert the linear polarization of the waves generated by the magnetron 28 to waves which have a circular polarization. The waves having the circular polarization are then guided into the heating cavity 14 via the inlet port 31. The waveguide 32 has a curved side wall, an open end provided with a flange, via which open end the waves of circular polarization are guided into the port 31, and a closed end provided with an end wall opposite the open end. The antenna inlet opening 34 is between the closed end and the formations 35, the formations 35 in turn being between the inlet opening 34 and the open end having the flange.

Figure 5:
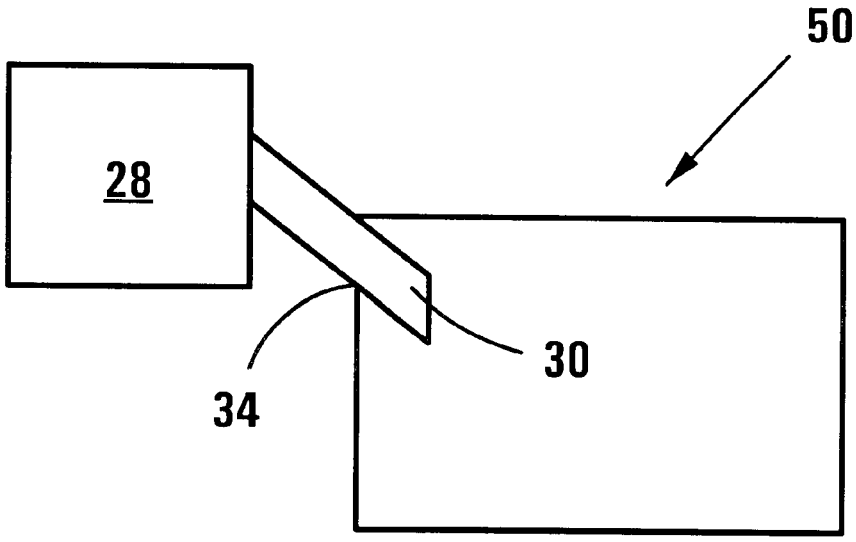
FIG. 5 shows a further embodiment of an electromagnetic power source with a hollow box-like elongate-rectangular waveguide in accordance with the invention.

Referring to FIG. 5 of the drawings, reference numeral 50 generally indicates a hollow box-like rectangular waveguide, in accordance with the invention, for guiding microwaves from a magnetron 28 to the inlet port 31 leading into the heating cavity 14 (see FIG. 1). Unlike the waveguide 32, the waveguide 50 is rectangular in cross-sectional outline and its inlet opening 34 is provided at a corner between two side walls of the waveguide 50, between its ends. The antenna 30 of the magnetron 28 projects into the inlet opening 34 and generates linearly polarized waves which, due to the angle of entry of the microwaves into the interior of the waveguide 50, which angle is established by routine experimentation, and the dimensions of the waveguide 50, produce circularly polarized waves which travel and are guided along the waveguide 50 into the heating cavity 14, the waveguide 50 being closed by a wall at one end and open at the other end for feeding the circularly polarized waves into the port 31.

Figure 6:
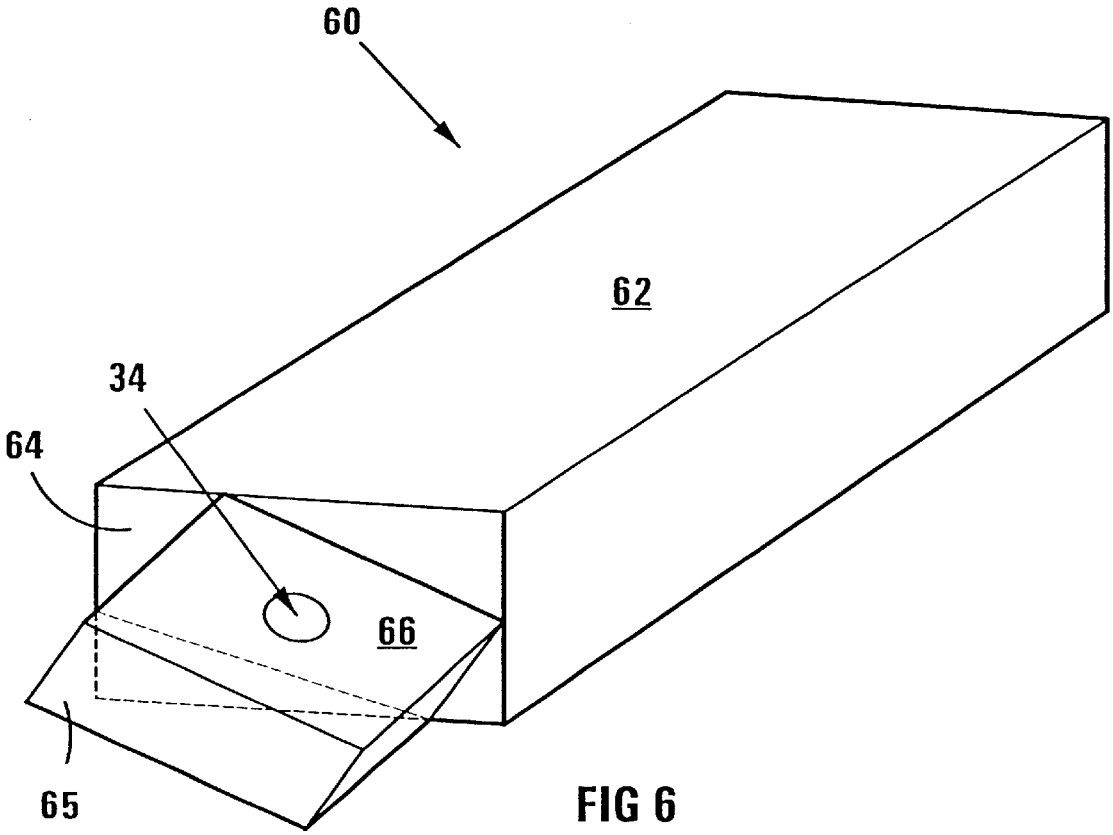
FIG. 6 shows a yet further embodiment of an electromagnetic power source with a hollow box-like elongate-rectangular waveguide in accordance with the invention.

Referring in particular to FIG. 6 of the drawings, reference numeral 60 generally indicates a further embodiment of a hollow box-like elongate-rectangular waveguide, also in accordance with the invention.

The wave guide 60 comprises a hollow elongate-rectangular feeder or guide portion 62 having an end wall 64 on which is mounted an open-ended box-like compartment 65. The end wall 64 has a rectangular opening 66 therethrough which corresponds in shape and dimensions to the open end of the compartment 65, the open end of the compartment 65 registering with the opening 66. The guide portion 62 is open at its end remote from the compartment 65 for feeding microwaves, guided from the compartment 65 along the guide portion 62 to the open end of the guide portion 62, into the port 31 of the cavity 14. The peripheral edges of the opening 66 are inclined at an angle to the peripheral edges of the end wall 64, and the corners of the opening 66 are located respectively on the peripheral edges of the wall 64. In use electromagnetic waves can flow freely between the interiors of the guide portion 62 and compartment 65. An inlet opening into the waveguide 60 is provided by an antenna inlet 34 for receiving the antenna 30 of a magnetron 28 (see FIGS. 2 and 3). The inlet 34 is through a wall 67 of the compartment 65, which wall 67 is parallel to the long dimension of the guide portion 62. In use, the waveguide 60 converts linearly polarized microwaves fed by the antenna into the compartment 65 into circularly polarized waves which travel from the compartment 65 along the guide portion 62 into the port 31 of the cavity 14. The inclination of the edges of the opening 66 to the peripheral edges of the wall 64 is selected by routine experimentation to achieve this conversion of linear to circular polarization.

The invention, as illustrated, acts to provide an improved dielectric heating device 10 in which electromagnetic waves which are circularly polarized are fed into the heating cavity 14. The circularly polarized electromagnetic waves encourage the heating cavity 14 to act as a multi-mode resonant heating cavity, thereby enhancing uniformity of the heating process within the cavity 14. Further, the waveguides 32, 50, 60 provide relatively simple conversions means for converting electromagnetic waves which have a linear polarization to waves which have a circular polarization. As construction of the waveguides 32, 50, 60 is relatively simple, manufacturing costs of the heating device 10 need not be materially increased by use thereof.

What is claimed is:

1. A dielectric heating device, the device including:

a plurality of electrically conductive side walls which are electrically interconnected in use and arranged in series to define a heating cavity, at least one pair of adjacent side walls being inclined to each other to define an included angle selected from the group consisting of acute angles and obtuse angles; and at least one electromagnetic power source capable of emitting electromagnetic radiation suitable for dielectric heating, the electromagnetic power source being arranged to feed electromagnetic waves of such radiation into the cavity to cause the cavity to act as a multimode resonant heating cavity, the electromagnetic power source including a microwave generator which generates microwaves having linear polarization, and a waveguide to guide the microwaves away from the microwave generator into the heating cavity, the waveguide being hollow and circular-cylindrical in shape with a curved side wall and having an inlet opening connected to the microwave generator and the wave guide containing a pair of diametrically opposed conversion formations projecting radially inwardly from the curved side wall to convert the linear polarization of the microwaves to circular polarization thereof.

2. A device as claimed in claim 1, in which the inlet opening of the waveguide is through the curved side wall of the waveguide.

3. A device as claimed in claim 1, in which the waveguide has a closed end and an open end opposite the closed end for feeding the electromagnetic waves into the heating cavity.

4. A device as claimed in claim 1, in which each conversion formation is in the form of a flattened elongate panel having a long dimension extending lengthwise along the circular-cylindrical waveguide, the panels being coplanar and radially inner edges of the panels being opposed to and diametrically spaced from each other.

5. A device as claimed in claim 1, in which the microwave generator is a magnetron having an antenna which projects through the inlet opening of the waveguide, into the hollow interior of the waveguide.

6. A device as claimed in claim 1, which is in the form of a microwave oven.

7. An electromagnetic power source capable of emitting electromagnetic radiation suitable for dielectric heating, the electromagnetic power source including a microwave generator which generates microwaves having linear polarization, and a waveguide to guide the microwaves away from the microwave generator, the waveguide being hollow and circular-cylindrical in shape with a curved side wall and having an inlet opening connected to the microwave generator and the wave guide containing a pair of diametrically opposed conversion formations projecting radially inwardly from the curved side wall to convert the linear polarization of the microwaves to circular polarization thereof.

8. An electromagnetic power source as claimed in claim 7, in which the inlet opening of the waveguide is through the curved side wall of the waveguide.

9. An electromagnetic power source as claimed in claim 7, in which the waveguide has a closed end and an open end opposite the closed end.

10. An electromagnetic power source as claimed in claim 7, in which each conversion formation is in the form of a flattened elongate panel having a long dimension extending lengthwise along the circular-cylindrical waveguide, the panels being coplanar and radially inner edges of the panels being opposed to and diametrically spaced from each other.

11. An electromagnetic power source as claimed in claim 7, in which the microwave generator is a magnetron having an antenna which projects through the inlet opening of the waveguide, into the hollow interior of the waveguide.

12. A dielectric heating device, the device including:

a plurality of electrically conductive side walls which are electrically interconnected in use and arranged in series to define a heating cavity, at least one pair of adjacent side walls being inclined to each other to define an included angle selected from the group consisting of acute angles and obtuse angles; and at least one electromagnetic power source capable of emitting electromagnetic radiation suitable for dielectric heating, the electromagnetic power source being arranged to feed electromagnetic waves of such radiation into the cavity to cause the cavity to act as a multimode resonant heating cavity, the electromagnetic power source including a microwave generator which generates microwaves having linear polarization, and a waveguide to guide the microwaves away from the microwave generator into the heating cavity, the waveguide being a hollow box of rectangular transverse section and having an inlet opening connected to the microwave generator, the inlet opening being arranged, and the waveguide being dimensioned, to convert the linear polarization of the microwaves to circular polarization thereof.

13. A device as claimed in claim 12, in which the inlet opening is through a corner of the waveguide between two side walls of the waveguide, at a position between opposite ends of the waveguide, one end of the waveguide being open for feeding the microwaves into the heating cavity.

14. A device as claimed in claim 12, in which the waveguide has an open end for feeding the microwaves into the heating cavity, an opposite end of the waveguide having an end wall with an opening therethrough and to which a box-like compartment inclined at an angle to peripheral edges of the end wall and in communication with the opening in the end wall is mounted, with the inlet opening being in a wall of the box-like compartment which is parallel to an axial dimension of the waveguide.

15. A device as claimed in claim 12, in which the microwave generator is a magnetron having an antenna which projects through the inlet opening of the waveguide.

16. An electromagnetic power source capable of emitting electromagnetic radiation suitable for dielectric heating, the electromagnetic power source including a microwave generator which generates microwaves having linear polarization, and a waveguide to guide the microwaves away from the microwave generator, the waveguide being a hollow box of rectangular transverse section and having an inlet opening connected to the microwave generator, the inlet opening being arranged, and the waveguide being dimensioned, to convert the linear polarization of the microwaves to circular polarization thereof.

17. An electromagnetic power source as claimed in claim 16, in which the inlet opening is through a corner of the waveguide between two side walls of the waveguide, at a position between opposite ends of the waveguide, one end of the waveguide being open.

18. An electromagnetic power source as claimed in claim 16, in which the waveguide has an open end and an opposite end of the waveguide has an end wall with an opening therethrough and to which a box-like compartment inclined at an angle to peripheral edges of the end wall and in communication with the opening in the end wall is mounted, with the inlet opening being in a wall of the box-like compartment which is parallel to an axial dimension of the waveguide.

19. An electromagnetic power source as claimed in claim 16, in which the microwave generator is a magnetron having an antenna which projects through the inlet opening of the waveguide.

* * * * *

UNITED STATES PATENT AND TRADEMARK OFFICE

CERTIFICATE OF CORRECTION

PATENT NO. : 6,396,037 B1
DATED : May 28, 2002
INVENTOR(S) : Rossouw et al.

It is certified that error appears in the above-identified patent and that said Letters Patent is hereby corrected as shown below:

Title page,
Item [54], please insert -- USING CIRCULARLY POLARIZED MICROWAVES -- after "DEVICE".

Signed and Sealed this

Twenty-second Day of October, 2002

*Attest:*

*Attesting Officer*

JAMES E. ROGAN
*Director of the United States Patent and Trademark Office*